US007353756B2

(12) United States Patent
LeaSure

(10) Patent No.: US 7,353,756 B2
(45) Date of Patent: Apr. 8, 2008

(54) LEAD FREE REDUCED RICOCHET LIMITED PENETRATION PROJECTILE

(75) Inventor: John D. LeaSure, Virginia Beach, VA (US)

(73) Assignee: AccuTec USA, Virginia Beach, VA (US)

( * ) Notice: Subject to any disclaimer, the term of this patent is extended or adjusted under 35 U.S.C. 154(b) by 235 days.

(21) Appl. No.: 10/783,066

(22) Filed: Feb. 20, 2004

(65) Prior Publication Data

US 2004/0159262 A1 Aug. 19, 2004

Related U.S. Application Data

(63) Continuation-in-part of application No. 10/119,912, filed on Apr. 10, 2002, now abandoned.

(51) Int. Cl.
*F42B 12/74* (2006.01)

(52) U.S. Cl. ..... 102/517; 102/506

(58) Field of Classification Search ..... 102/506, 102/501, 517, 511

See application file for complete search history.

(56) References Cited

U.S. PATENT DOCUMENTS

| | | | | |
|---|---|---|---|---|
| 4,963,165 | A | 10/1990 | Blume et al. | 55/16 |
| 5,233,928 | A | 8/1993 | Ducros et al. | 102/434 |
| 5,237,930 | A | 8/1993 | Belanger et al. | 102/529 |
| 5,399,187 | A | 3/1995 | Mravic et al. | 75/228 |
| 5,616,642 | A | 4/1997 | West | 524/439 |
| 5,665,808 | A * | 9/1997 | Bilsbury et al. | 524/439 |
| 5,963,776 | A * | 10/1999 | Lowden et al. | 419/64 |
| 5,986,005 | A | 11/1999 | Jacquemet et al. | 525/178 |
| 6,048,379 | A * | 4/2000 | Bray et al. | 75/229 |
| 6,257,149 | B1 * | 7/2001 | Cesaroni | 102/515 |
| 6,272,996 | B1 | 8/2001 | O'Brien et al. | 102/275.11 |
| 6,464,600 | B2 | 10/2002 | Takemura et al. | 473/378 |
| 6,617,383 | B2 * | 9/2003 | Ikawa et al. | 524/167 |
| 6,630,231 | B2 | 10/2003 | Perez et al. | 428/297.4 |
| 6,823,798 | B2 * | 11/2004 | Amick | 102/517 |
| 6,916,354 | B2 * | 7/2005 | Elliott | 75/228 |
| 2001/0031594 | A1 | 10/2001 | Perez et al. | 442/339 |
| 2004/0138361 | A1 * | 7/2004 | Cheng | 524/401 |

FOREIGN PATENT DOCUMENTS

EP 0 096 617 A1 * 12/1983

* cited by examiner

*Primary Examiner*—James S Bergin
(74) *Attorney, Agent, or Firm*—Joseph T. Guy; Nexsen Pruet, LLC

(57) ABSTRACT

A frangible projectile with a specific gravity similar to a lead projectile. The projectile comprises 34-94%, by weight, binder. The binder comprises poly ether block amide resin. The projectile further comprises 6-66%, by weight, ballast. The ballast comprises at least one member selected from a group consisting of tungsten, tungsten carbide, molybdenum, tantalum, ferro-tungsten, copper, bismuth, iron, steel, brass, aluminum bronze, beryllium copper, tin, aluminum, titanium, zinc, nickel silver alloy, cupronickel and nickel. The projectile can be prepared with a particularly preferred specific gravity of 5-14 and more preferably 11-11.5.

27 Claims, No Drawings

LEAD FREE REDUCED RICOCHET LIMITED PENETRATION PROJECTILE

RELATED APPLICATIONS

The present application is a continuation-in-part of U.S. patent application Ser. No. 10/119,912 filed Apr. 10, 2002 which is abandoned.

BACKGROUND OF THE INVENTION

Field of the Invention

The present invention relates to an improved composite projectile/projectile core with superior characteristics. More specifically, the present invention relates to a composite projectile/projectile core with a binder and a ballast, such as a metal or metal alloy, encased therein wherein the projectile is capable of being manufactured at a specific gravity closely resembling lead metal.

There has been a long felt desire to reduce the amount of lead in the environment. The impact of high levels of lead has been well documented and the desire to lower these levels is now well accepted.

The use of lead in projectiles, such as bullets or bullet cores, has been a widely accepted practice for generations. The intrinsic properties of lead make it particularly suitable for use as a projectile. Lead can be easily cast into desired shapes. The specific gravity and rheological properties of lead are particularly suitable for use as a projectile. The weight is sufficient for accurate flight and the material is soft enough to mushroom, or flatten into a disk, upon impact. These properties combined provide optimal flight characteristics and maximum kinetic energy transfer for effectiveness on impact. There is no suitable substitute for lead projectiles for hunting activities. The amount of lead entering the environment through hunting activities is minimal. Other metals may provide adequate specific gravities yet the ability to mushroom is compromised and therefore the projectile may pass through the intended target without mushrooming. This is undesirable as realized in the art.

Hunting enthusiast typically desire to practice the art by shooting at targets to insure that sights are properly aligned. This desire is in direct conflict with the desire to minimize lead deposition in the environment. If alternate projectiles are used the ballistics are different from lead projectiles. This difference is due, in part, to the difference in specific gravity. Practicing with a projectile with different ballistics may contradict the advantages gained by practicing. It is well known in the art that the adjustments of the sights on a firearm are very dependent on the weight of the projectile. This has caused a dilemma for hunting enthusiast. Presently this dilemma is not resolvable.

Shooting enthusiast, who primarily shoot at targets, have different needs. The number of shots fired at a designated shooting range can be very high. With lead projectiles there are several alternatives none of which are suitable. The lead projectile can be captured, in a sand pit, for example. Any material used to capture the lead is considered a toxic material and must be treated accordingly. This is cost prohibitive in many situations.

Many attempts have been made to create a projectile with acceptable properties yet which are free of lead. One approach, which has met with limited success, is the use of a binder within which metals, or metal alloys, are encased. The advantages of composite projectiles include the propensity to disintegrate on impact. This eliminates the need to capture the projectile. These types of projectiles are specifically for target shooting wherein maximum transfer of kinetic energy is not a desire and, in fact, is preferably avoided. The composite projectiles typically have a low specific gravity. The low specific gravity creates problems with flight consistency and, in some cases, they have insufficient recoil to initiate activation of the semi-automatic mechanisms of many firearms. While the composite projectiles are relatively successful for the shooting enthusiast the hunting enthusiast is still in a quandary. The low specific gravity renders these composites virtually useless for simulating the trajectory of lead projectiles. Furthermore, the size of the projectile utilized for hunting is typically larger than that used for target shooting and the presently available composites are not suitable for larger size projectiles.

In composite projectiles the binder acts as a matrix within which the metal, or metal alloy, is encased. The metal, or metal alloy, acts to ballast the projectile by increasing the specific gravity. The ballast is typically chosen from copper, tungsten, tungsten carbide, ferrotungsten, ceramic, bismuth, stainless steel, bronze and mixtures of these components.

Belanger, in U.S. Pat. No. 5,237,930, has described a composite projectile, comprising copper and nylon. The composition is demonstrated to achieve a projectile with a specific gravity of up to approximately 8.3. This is an insufficient replacement for a lead projectile with a specific gravity of approximately 11.3.

West et al., in U.S. Pat. No. 5,616,642, has described improvements to the projectile of Belanger. The projectile of West et al. utilizes a polyester resin with a higher specific gravity than nylon. These projectiles, while offering advantages, require jacketing to achieve the full advantages. The additional processing step is cost prohibitive.

There has been an ongoing need in the art for a frangible projectile with characteristics similar to a lead projectile.

BRIEF SUMMARY OF THE INVENTION

Hence, it is object of the present invention to provide a composite projectile with a specific gravity similar to lead.

Another object of the present invention is to provide a composite projectile with ballistics, which are predominantly dictated by specific gravity, similar to the ballistics for a lead projectile of the same size and shape.

Another object of the present invention is to provide a composite projectile capable of fragmenting upon impact. A particular feature of the present invention is the ability to fragment with minimal ricochet.

A specific advantage of the present invention is provided in a composite projectile substantially free of lead or alloys of lead.

Yet another specific advantage of the present invention is provided in the ability to include lubricants and reinforcement fiber in the binder of the composite projectile.

These and other advantages, as will be realized, are provided in a projectile comprising a ballast encased in a binder wherein the binder comprises polyether block amide resin.

Another preferred embodiment is provided in a frangible projectile comprising a binder. The binder comprises about 10-30%, by weight, poly ether block amid resin. The ballast comprises tungsten.

Yet another preferred embodiment is provided in a frangible projectile comprising 34-94%, by weight, binder and 6-66%, by weight, ballast. The binder comprises poly ether block amide resin. The ballast comprises at least one member selected from a group consisting of tungsten, tungsten carbide, molybdenum, tantalum, ferro-tungsten, copper, bismuth, iron, steel, brass, aluminum bronze, beryllium copper, tin, aluminum, titanium, zinc, nickel silver alloy, cupronickel and nickel. The projectile has a specific gravity of about 5 to about 14.

DETAILED DESCRIPTION OF THE INVENTION

The inventors of the present application have found, through diligent research, that frangible projectiles can be prepared with a ballast, particularly tungsten, and a binder comprising alloys of polyether block amides.

The projectile of the present invention comprises ballast encased in a binder. A particular advantage of the present invention is the ability to incorporate high levels of ballast. Particularly, the projectile comprises at least 6%, by weight, ballast, to no more than about 66% by weight, ballast. Below about 6%, by weight, ballast the specific gravity of the projectile is unacceptably low resulting in poor ballistic performance. More preferably the ballast is present in an amount of at least about 26%, by weight, to insure adequate consistency of the ballistic characteristics. More preferably, the ballast is present in an amount of at least about 39%, by weight, at which point the specific gravity approaches the specific gravity of lead and the ballistic characteristics of the projectile are predictive of the ballistic characteristics for lead projectiles. Above a ballast level of approximately 66%, by weight, the projectile has an insufficient amount of binder to form a matrix sufficient to withstand the combined effects associated with the initial acceleration and heat generated during firing and the centrifugal force and air resistance which are realized during flight. More preferably the projectile has no more than approximately 49%, by weight, binder. Most preferably, the projectile comprises approximately 45-49%, by weight ballast and 51-55%, by weight, binder.

The ballast preferably comprises a metal. Most preferably the ballast excludes lead metal. Preferred ballast comprise at least one material selected from the group of tungsten, tungsten carbide (carballoy), molybdenum, tantalum, ferro-tungsten, copper, bismuth, iron, steel, brass, aluminum bronze, beryllium copper, tin, aluminum, titanium, zinc, nickel silver alloy, cupronickel and nickel. Particularly preferred ballast comprise at least one material selected from the group of tungsten, tungsten carbide, molybdenum, tantalum, ferro-tungsten, copper, bismuth and iron. More preferred is a ballast comprising at least one material selected from the group of tungsten, tungsten carbide, tantalum, molybdenum and ferro-tungsten. The most preferred ballast comprises tungsten. Particularly preferred is a ballast consisting essentially of tungsten. For the present invention it is understood that the metals may be in the form of oxides, pure metals, or combinations.

The ballast is preferably incorporated as a powder. As would be readily understood from the description herein, a powder more readily disperses upon impact and imparts minimal kinetic energy to the target. The lower size limit of the ballast particles is chosen based on manufacturing convenience. If the particle size of the ballast is to small the powder becomes easily distributed by airflow and becomes a dusting hazard in the manufacturing process. This is undesirable in some circumstances. An average particle size just large enough to have minimal dusting is most preferred in most circumstances. The ability of the binder to wet the surface of the ballast is also a consideration in choosing particle size. If the surface of the ballast is not properly wetted by the binder a larger particle size may be required to insure adequate specific gravity and to exclude air inclusion. The upper size limit is dictated by the acceptable amount of energy the target can withstand. It is most preferred that the particle size be at least about 149 to no more than about 1,000 μm.

The binder comprises poly ether block amide resin (PEBA). PEBA is a regular linear chain of rigid polyamide segments interspaced with flexible poly ether segments. PEBA is readily available commercially under the trade name PEBAX®. The binder may comprise additional additives which are advantageous to the composite projectile. Particularly preferred are additional resins blended, or alloyed, with PEBA. Additives can be employed to assist in the manufacturing process such as wetting agents. It has been found to be particularly advantageous to incorporate lubricants and/or reinforcing fibers into the binder.

PEBA is a copolymer of amides and ether. A particularly preferred embodiment is a high specific gravity PEBA. PEBA can be alloyed with other resins such as nylon and polybutylene terephthalate (PBT). Particularly preferred nylon resins include nylon 6, nylon 6/6, nylon 11 and nylon 12. In a particularly preferred embodiment PEBA is alloyed with high specific gravity nylon. Blends of PEBA with nylon are commercially available from various sources. In a preferred embodiment the binder comprises at least approximately 10%, by weight, PEBA to no more than about 30%, by weight, PEBA. The remainder of the binder comprises a second resin, and other materials such as lubricants and fibers. In a particularly preferred embodiment the binder comprises at least about 70%, by weight, to no more than about 90%, by weight, second resin selected from nylon and PBT. PEBA is readily available commercially with representative examples including PEBAX® MV1074 and MH1657 from Elf Atochem. The vendor or specific grade is not specific with higher specific gravity PEBA being most preferred.

It is preferred to incorporate lubricants into the binder to facilitate manufacturing, reduce wear rate and increase pressure velocity limits. It is most preferred that the lubricant be blended into the binder. The lubricant can be solid or liquid with a solid being preferred. Migrating lubricants are particularly preferred since they can be incorporated at lower levels in the matrix. Particularly preferred lubricants include molybdenum disulfide, silicone, polytetrafluoethylene (PTFE) and mineral oil.

Molybdenum disulfide is a particularly useful solid lubricant when incorporated into the inventive binder. While not limited to any theory, molybdenum disulfide is considered particularly useful for reducing wear rates and increasing pressure velocity limits. Molybdenum disulfide is also considered to be a nucleating agent and may participate in enabling the molded part to have a very fine crystalline structure.

Silicone is a particularly advantageous boundary lubricant. Silicone reduces wear rates and coefficients of friction when compounded at lower levels into the inventive binder. Silicone migrates to the surface of a molded part due, in part, to the limited compatibility with the binder. The migrating silicone provides a near continuous generation of silicone film which serves as a boundary or mixed film lubricant.

PTFE, when compounded with the binder of the present invention, significantly reduces the wear rate of a composite. PTFE has a very low coefficient of friction. A particularly preferred lubricant is a mixture of PTFE, silicone and mineral oil. The mixture provides immediate lubrication from the migratory silicone which acts to enhance wear characteristics at high speeds or velocities and increases pressure velocity compared to lubrication alone.

Fibers have been demonstrated to be particularly beneficial when incorporated into the binder. Fibers which are advantageously added to the binder include nylon fibers, glass fibers and carbon fibers. Nylon fibers are particularly preferred. A particularly preferred nylon fiber is aramid. In a particularly preferred embodiment aramid fiber is added at levels of about 1 to about 30%, by weight, to the binder. More preferably the fiber is added at levels of about 1 to about 15%, by weight. Even more preferably, the fiber is added at levels of about 3 to about 7%, by weight. Particularly preferred is about 5%, by weight fiber. Incorporating aramid fibers increases the lubricity of the binder and reduces the wear factor of the thermoplastic resin of the binder. A particularly preferred embodiment incorporates aramid fibers in conjunction with silicone and PTFE. This combination further reduces wear rates and frictional coefficients.

Plasticizers are preferably incorporated into the binder. Preferred plasticizers include sulfonamides with aromatic sulfonamides being more preferred. A particularly preferred plasticizer is n-butylbenzene sulfonamide available from Unitex Chemical Corporation as UNIPLEX 214.

Aramid fibers are nylon comprising an aromatic ring in the nylon backbone. Particularly preferred aramid fibers include Nomex®, Kevlar®, and blends thereof.

The specific gravity of the composite projectile is preferably approximately equal to the specific gravity of lead for reasons set forth herein. Even though this is most preferred it is also understood that the advantages offered with the composite projectile can be advantageous at other levels of specific gravity for different applications. For example, it is not uncommon for shooting enthusiast to utilize sub-optimal materials, such as copper projectiles, due to the environmental concerns associated with lead. One advantage of the present invention is the ability to utilize the composite projectile at lower specific gravity levels to accommodate various applications in the art. A shooting enthusiast may, for example, typically utilize a projectile with a specific gravity of 8. While this is known to be less than desirable the environmental hazards associated with lead dictate, in some cases, use of a projectile that is less than desirable. The present invention can be utilized at a lower specific gravity to accommodate the shooting enthusiast thereby allowing them to take advantage of the superior properties of the inventive projectile without adjusting the sights of the firearm. A particular advantage of the present invention is the ability to provide a superior projectile at a specific gravity of lead and at specific gravity levels commonly employed without foregoing the other advantages, such as low ricochet, offered by the inventive projectile. It is preferred that the composite projectile have a specific gravity of at least 5, more preferably at least 5.7, to insure adequate recoil for use in semi-automatic firearms. More preferably the specific gravity is at least 8 to insure adequate flight consistency, which leads to improved accuracy. Even more preferably the specific gravity is at least 10. Most preferably the specific gravity is at least 11. A specific gravity above the specific gravity of lead is achievable but not desirable in most circumstances. It is most preferred that the specific gravity not exceed approximately 14. It is most preferred that the specific gravity be at least about 11 to no more than about 11.5.

The projectile of the present invention exhibits excellent results with regard to the low amount of fragmented material ricocheting from the target. Reduced Ricochet is a function of the degree of densification and the type of consolidation technique, such as injection molding under pressure. Powder particle size and porosity. The higher the specific gravity or density, the greater the degree of reduced ricochet.

The projectiles of the present invention can be prepared utilizing standard molding techniques. It is preferable to maintain lower melt temperatures of less than 490-520° F. with the inventive composites to avoid separation of the filler and resin which can occur at excessively high temperatures. A melt temperature of approximately 500° F. is eminently suitable for demonstration of the teachings herein.

EXAMPLES

Example 1

Projectiles of the present invention were prepared in accordance with the following procedure. A composition was prepared comprising 90%, by weight, tungsten and 10%, by weight PEBA alloyed with impact modified nylon 6 which was internally lubricated with Silicon, PTFE and Mineral Oil. Tungsten metal was obtained from Micron Metals, Inc. as WP106. PEBA was obtained from Atofina Chemicals, Inc., as PEBAX® MH1657. Impact modified nylon 6 was obtained from LNP Engineering Plastics, Inc. as Thermocomp HSG-P-1100A EXP. The mixture was dried for a minimum of 4-6 hours at 180° F. in a dehumidifying oven prior to molding into a projectile. A conventional ram, or reciprocating screw injection molding machine was used to form the projectile. The processing conditions included a mold temperature of 180° F., and a melt temperature of 490° F. at 25,000 psi. A 9 mm projectile was prepared with a weight of 124 grains and a length of 0.600 inches. The specific gravity was measured, using standard techniques, to be 11.2. The cited art is incapable of preparing a stable projectile with the weight and density obtained with the sample projectile. The 124 grain 9 mm projectile was loaded and fired from a 9 mm cal Beretta 92 SM 4.3 inch barrel pistol producing an average velocity of 1109 feet per second and a chamber pressure of 28,520 PSI at a distance of 7 yards against a ¼ inch AISI steel plate 48×48×¼ at a striking angle of 10 degrees. The Reduced Ricochet Limited Penetration 9 mm projectile completely disintegrated producing no "Splashback" or projectile fragments.

Example 2

A projectile was prepared in accordance with the procedure and composition described in Example 1. A 5.56 mm projectile was prepared at a weight of 62 grains and 0.740 inches in length.

Example 3

A projectile was prepared in accordance with the procedure and composition described in Example 2. A subsonic 5.56 mm projectile was prepared at a weight of 114 grains and 1.15 inches in length.

The present invention has been described with particular reference to the preferred embodiments. These embodiments are intended to provide teachings that would allow one of ordinary skill in the art to utilize the teachings herein without undue experimentation. The invention is more clearly set forth in the claims which are appended hereto.

Claimed is:

1. A projectile comprising a ballast encased in a binder wherein said binder comprises a resin comprising linear chains of rigid polyamide segments interspaced with flexible poly ether segments and said projectile has a minimum specific gravity of 5.

2. The projectile of claim 1 comprising about 6 to about 66%, by weight, said ballast and about 34-94%, by weight, said binder.

3. The projectile of claim 2 comprising 45-49%, by weight, said ballast and 51-55%, by weight, said binder.

4. The projectile of claim 1 wherein said binder further comprises a second resin.

5. The projectile of claim 4 wherein said binder comprises about 10 to about 30%, by weight, said a resin comprising linear chains of rigid polyamide segments interspaced with flexible poly ether segments and about 70 to about 90%, by weight, said second resin.

6. The projectile of claim 4 wherein said second resin is selected from a group consisting of nylon and polybutylene terephthalate.

7. The projectile of claim 4 wherein said ballast comprises at least one member selected from a group consisting of tungsten, tungsten carbide, molybdenum, tantalum, ferro-tungsten, copper, bismuth, iron, steel, brass, aluminum bronze, beryllium copper, tin, aluminum, titanium, zinc, nickel silver alloy, cupronickel and nickel.

8. The projectile of claim 7 wherein said ballast comprises at least one member selected from a group consisting of tungsten, tungsten carbide, tantalum, molybdenum and ferro-tungsten.

9. The projectile of claim 1 wherein said projectile has a minimum specific gravity of 10.

10. The projectile of claim 1 wherein said binder further comprises a fiber.

11. The projectile of claim 1 wherein said binder further comprises a lubricant.

12. The frangible projectile of claim 1 further comprising a plasticizer.

13. The frangible projectile of claim 12 wherein said plasticizer is a sulfonamide.

14. The frangible projectile of claim 13 wherein said plasticizer is an aromatic sulfonamide.

15. The frangible projectile of claim 14 wherein said plasticizer is n-butylbenzene sulfonamide.

16. A projectile comprising a ballast encased in a binder wherein said binder comprises a resin comprising linear chains of rigid polyamide segments interspaced with flexible poly ether segments and said projectile has a minimum specific gravity of 5 wherein said ballast consist essentially of tungsten.

17. A frangible projectile comprising:

34-94%, by weight, binder wherein said binder comprises a resin comprising linear chains of rigid polyamide segments interspaced with flexible poly ether segments; and 6-66%, by weight, ballast wherein said ballast comprises at least one member selected from a group consisting of tungsten, tungsten carbide, molybdenum, tantalum, ferro-tungsten, copper, bismuth, iron, steel, brass, aluminum bronze, beryllium copper, tin, aluminum, titanium, zinc, nickel silver alloy, cupronickel and nickel; and wherein said projectile has a specific gravity of about 5 to about 14.

18. The frangible projectile of claim 17 wherein said projectile has a specific gravity of at least about 10.

19. The frangible projectile of claim 18 wherein said projectile has a specific gravity of about 11 to about 11.5.

20. The frangible projectile of claim 17 further comprising a second resin.

21. The frangible projectile of claim 20 wherein said second resin is selected from a group consisting of nylon and polybutylene terephthalate.

22. The frangible projectile of claim 20 wherein said second resin is nylon selected from a group consisting of nylon 6, nylon 6/6, nylon 11 and nylon 12.

23. The frangible projectile of claim 17 wherein said binder further comprises a fiber.

24. The frangible projectile of claim 23 wherein said fiber is an aramid.

25. The frangible projectile of claim 17 wherein said binder further comprises a lubricant.

26. The frangible projectile of claim 25 wherein said lubricant is at least one material chosen from a group consisting of molybdenum disulfide, silicone, polytetrafluoethylene and mineral oil.

27. A projectile comprising a ballast encased in a binder wherein said binder comprises a resin comprising linear chains of rigid polyamide segments interspaced with flexible poly ether segments and said projectile has a minimum specific gravity of 5 wherein said ballast consist of tungsten carbide, molybdenum, tantalum, ferro-tungsten, copper, bismuth, iron, steel, brass, aluminum bronze, beryllium copper, tin, aluminum, titanium, zinc, nickel silver alloy, cupronickel and nickel.

* * * * *

UNITED STATES PATENT AND TRADEMARK OFFICE

CERTIFICATE OF CORRECTION

PATENT NO. : 7,353,756 B2
APPLICATION NO. : 10/783066
DATED : April 8, 2008
INVENTOR(S) : John D. LeaSure It is certified that error appears in the above-identified patent and that said Letters Patent is hereby corrected as shown below:

Change:

(73) Assignee: AccuTec USA, Virginia Beach, VA (US)

to read

(73) Assignee: John D. LeaSure, Virginia Beach, VA (US)

Signed and Sealed this

Eighteenth Day of August, 2009

David J. Kappos

David J. Kappos
*Director of the United States Patent and Trademark Office*